US007118398B2

(12) United States Patent
Leidy

(10) Patent No.: US 7,118,398 B2
(45) Date of Patent: Oct. 10, 2006

(54) ELECTRICAL CONNECTOR HAVING GUIDE-IN ARRANGEMENT

(75) Inventor: James Albert Leidy, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/883,881

(22) Filed: Jul. 2, 2004

(65) Prior Publication Data

US 2006/0003618 A1 Jan. 5, 2006

(51) Int. Cl.
*H01R 13/62* (2006.01)

(52) U.S. Cl. ..... 439/160

(58) Field of Classification Search ..... 439/160, 439/157, 159, 152, 153, 372
See application file for complete search history.

(56) References Cited

U.S. PATENT DOCUMENTS 5,470,240 A 11/1995 Suzuki
5,660,552 A 8/1997 Suzuki et al.
5,746,613 A * 5/1998 Cheng et al. ..... 439/157
6,276,950 B1 8/2001 Yodogawa

FOREIGN PATENT DOCUMENTS

JP 5-121130 5/1993

* cited by examiner

*Primary Examiner*—Javaid H. Nasri
(74) *Attorney, Agent, or Firm*—Wei Te Chung

(57) ABSTRACT

An electrical connector (1) includes an insulative housing (10) having a first end (14) having a supporting section (13), a second opposite end (16) including a lever (17), and a slot (18) extending from the first end to the second end, and a number of electrical terminals (12) mounted to the insulative housing. A memory module (2) has a first side portion (20) including a side engaging section (26), an opposite second side portion (22) including a locking section (28) and a number of conductive pads (21). When the memory module is to mate with the electrical connector, the side engaging section engages with the supporting section and the memory module is rotated on the supporting section to mate the conductive pads with the electrical terminals sequentially from the first end to the second end. The lever locks with the locking section to hold the memory module in the slot.

5 Claims, 8 Drawing Sheets

ELECTRICAL CONNECTOR HAVING GUIDE-IN ARRANGEMENT

BACKGRAOUND OF THE INVENTION

1. Field of the Invention

The present invention relates to an electrical connector, and more particularly to an electrical connector having a guide-in arrangement in which an inserted substrate, such as a memory card, is pivotally supported at one end of the connector, and then cam-into the connector centered by the end so as to reduce the insertion force.

2. Description of the Prior Art

An electrical connector is used to detachably or separately interconnect two electrical devices together. It embodies a variety of configurations as well as structures in view of its application and intended performance.

U.S. Pat. No. 4,846,734 issued to Lytle and U.S. Pat. No. 4,996,766 issued to Piorunnect disclose the so-called card-edge connector in which a memory module or add-in circuit card can be electrically interconnected to a motherboard through the connectors disclosed.

U.S. Pat. Nos. 4,995,825 and 5,013,257 issued to Korsunsky disclosed a memory connector similar to the card-edge connector discussed above.

U.S. Pat. No. 5,074,800 issued to Sasao et al. disclose another memory card connector in which an ejector is incorporated so as to easily remove the inserted memory card from the connector.

The electrical connector disclosed above comprises an insulative housing defining a slot therein and a plurality of electrical terminals mounted on the insulative housing and electrically contacted with conductive pads of the memory module inserted into the slot of the insulative housing. An insertion force needed to insert the memory module into the slot of the electrical connector is made up of two subsets: (1) when the memory module first approaches the electrical connector, the terminals must be displaced for insertion of the memory module. The degree or magnitude of this force is a function of: the Young's module of the terminal, the shape of the leading edge of the memory module, and the number of the terminals displaced by the inserted memory module. (2) After the terminals are deflected and initial engagement between the electrical terminals of the connector and conductive pads on the memory module is attained, the insertion force is then a function of the coefficient of friction between the conductive pads and terminals, the normal force exerted by the terminals, and finally the number of the terminals.

With the development in the electrical connector field, the electrical connectors are required to transmit signals in a more and more larger quantity per unit and in a more and more faster speed. In turn, the number of the electrical terminals of each electrical connector is increased and an insertion force needed to insert the memory module into the electrical connector is increased accordingly, which is undesirable for the user who mounts the memory module onto the electrical connector. In addition, it is also undesirable for the user since a large force is still needed to eject the memory module from the electrical connector. Proposals to reduce the insertion force include: reducing the normal force, charnfering the memory module, adding a secondary cam mechanism, applying lubricant and reducing the number of terminals deflected at one time by staggering the terminal heights, such as Piorunnect disclosed in his invention.

U.S. Pat. Nos. 5,660,552 (the '552 patent) and 6,276,950 (the '950 patent) issued to Suzuki et al and Yodogawa, respectively, address the problem of extracting the inserted memory module from the electrical connector. The Suzuki et al. disclose an electrical connector extracting a memory module received therein when a push-button of a first crank arm formed on one of two longitudinal ends of the insulative housing thereof is pushed to rotate the first crank arm outwardly to rotate a second crank arm to lift up one side edge of the memory module. As clearly shown in FIG. 5A of Suzuki and FIG. 1 of the Yodogawa, the memory card is inserted substantially to the prior arts discussed above.

U.S. Pat. No. 5,470,240 issued to Suzuki discloses another electrical connector which is very similar to Sasao. Suzuki's 240 provides a dynamic pivotal support to the inserted memory module by a first lever. The memory module is then by rotated and gradually inserted into the insulative housing. When the module is to be ejected, a wrench arm of the second lever is pried so as to eject the memory module. The electrical connector of the '240 patent is purported to address the problem of decreasing the force needed to insert the memory module into the insulative housing. However, it is often difficult to manipulate the insertion process since both the memory module and the lever are floatable. This is not easy to manipulate. Furthermore, the memory module moves a relatively longer distance and conductive pads thereof are often scratched by electrical terminals of the electrical connector which are not the ones intended to finally mate with. In such a way, a reliable and easy electrical interconnection between the memory module and the electrical connector is highly expected.

SUMMARY OF THE INVENTION

A first object of the present invention is to provide an electrical connector which correctly receives a memory module therein with a low insertion force.

A second object of the present invention is to provide an electrical connector which ensures a reliable electrical connection with a memory module received therein.

An electrical connector in accordance with the present invention comprises an insulative housing and a plurality of electrical terminals mounted to the insulative housing. The insulative housing defines a first end, an opposite second end and a slot extending from the first end to the second end. The first end is formed with a tower extending upwardly therefrom and comprising a supporting section thereon. The second end comprises a lever pivotally assembled thereto. A memory module comprises a first side portion having a side engaging section, a second side portion having a locking section and a plurality of conductive pads.

When the memory module is to mate with the electrical connector, the side engaging section engages with the supporting section and the memory module is rotated on the supporting section to mate the conductive pads with the electrical terminals sequentially from the first end to the second end. The lever is rotated inwardly to lock with the locking section to hold the memory module in the slot of the electrical connector. When the memory module is to be withdrawn from the slot of the electrical connector, the lever is rotated outwardly to lift up the second side portion of the memory module firstly. In the course of the movement of the memory module with respect to the electrical connector, each electrical terminal only contacts with one corresponding conductive pad with which it is finally mated.

Other objects, advantages and novel features of the invention will become more apparent from the following detailed description of the present embodiment when taken in conjunction with the accompanying drawings.

DETAILED DESCRIPTION OF THE PREFERRED EMBODIMENTS

Figure 1:
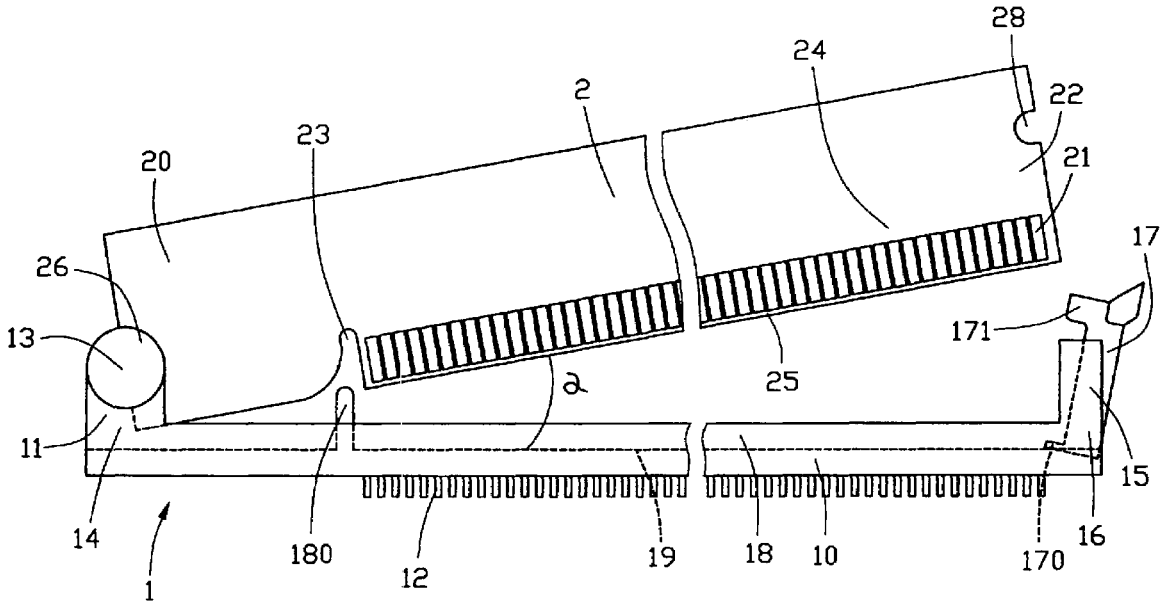
FIG. 1 is a front view of an electrical connector in accordance with a first embodiment of the present invention and a memory module matable with the electrical connector, showing the memory module is to be inserted into the electrical connector.

Referring to FIG. 1, an electrical connector 1 in accordance with a first embodiment of the present invention is adapted to mate with a memory module 2. The memory module 2 comprises a first side portion 20, an opposite second side portion 22 and a lower portion 24. The first side portion 20 comprises a side engaging section 26, such as a cutout in this preferred embodiment of the present invention, at a lateral end thereof. The second side portion 22 comprises a locking section 28, such as a cutout in this preferred embodiment, at a lateral end thereof. The lower portion 24 comprises a plurality of conductive pads 21 arranged from the first side portion 20 to the second side portion 22 and a key slit 23 open to a lower end 25 thereof.

The electrical connector 1 comprises an insulative housing 10, a plurality of electrical terminals 12 mounted to the insulative housing 10. The insulative housing 10 defines a first end 14, an opposite second end 16, a slot 18 extending from the first end 14 to the second end 16 to receive the electrical terminals 12 partially extending thereinto, and a key 180 protruding into the slot 18. The key 180 corresponds to the key slit 23 of the memory module 2 to ensure the memory module 2 is received in the electrical connector 1 in a correct way. The number and the location of the key 180 and the key slit 23 may be changed according to specific application environments. The first end 14 comprises a tower 11 extending upwardly therefrom and comprising a supporting section 13, a protrusion configured corresponding to the side engaging section 26 in this preferred embodiment, at an upper section thereof. The second end 16 comprises a shoulder 15 and a lever 17 pivotally assembled to the shoulder 15. The lever 17 is formed with a hook section 170 at a lower end thereof and a projection 171 at an upper end thereof.

Figure 2:
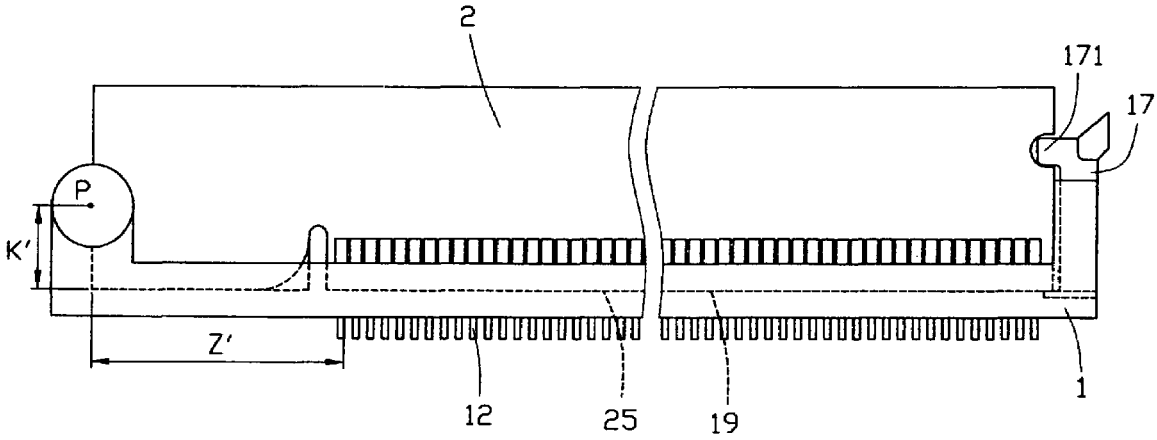
FIG. 2 is a view similar to FIG. 1 but the memory module has been fitted in the electrical connector.

When the memory module 2 is to be inserted into the slot 18 of the insulative housing 10, the side engaging section 26 of the first side portion 20 of the memory module 2 engages with the supporting section 13 of the tower 14 of the insulative housing 10 in such a way that the lower end 25 of the memory module 2 defines an angle a with respect to a bottom face 19 of the slot 18 of the insulative housing 10. The angle $\alpha$ is preferably an acute angle and is about 8–9 degrees. The memory module 2 is then pressed to move clockwisely toward the insulative housing 10 until the lower end 25 of the second side portion 22 thereof reaches the bottom face 19 of the slot 18. Referring to FIG. 2, the lever 17 is inwardly rotated until the projection 171 engages with the locking section 28. In such a situation, the lower end 25 of the memory module 2 is parallel to the bottom face 19 and the memory module 2 is securely located in the electrical connector 1.

Figure 3:
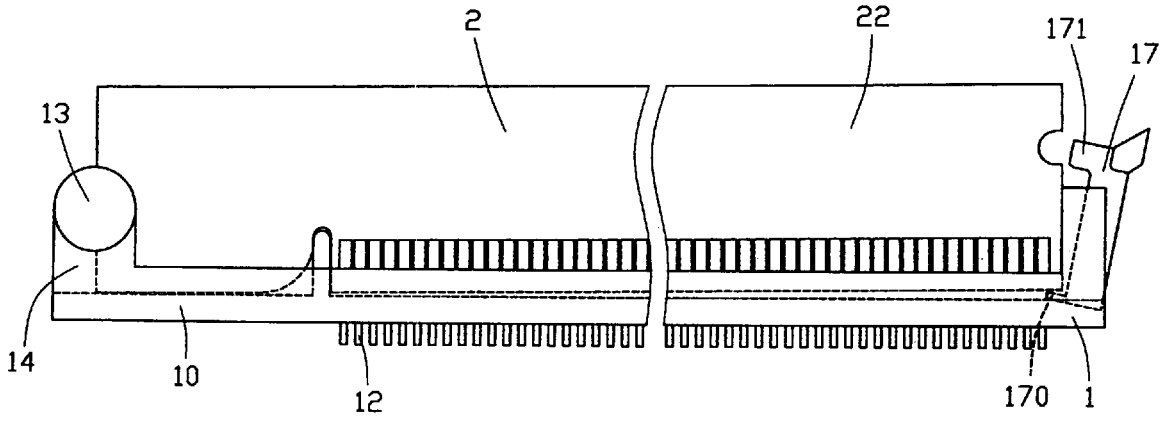
FIG. 3 is a view similar to FIG. 2, but showing the memory module is partly extracted from the electrical connector.

Referring to FIG. 3, to extract the memory module 2 from the electrical connector 1, the lever 17 is rotated outwardly in such a way that the hook section 170 thereof lifts up the second side portion 22 of the memory module 2 firstly. The memory module 2 is then rotated anticlockwisely about the supporting section 13 of the first end 14 of the insulative housing 10 until the memory module 2 is completely moved out of the electrical connector 1.

Figure 4:
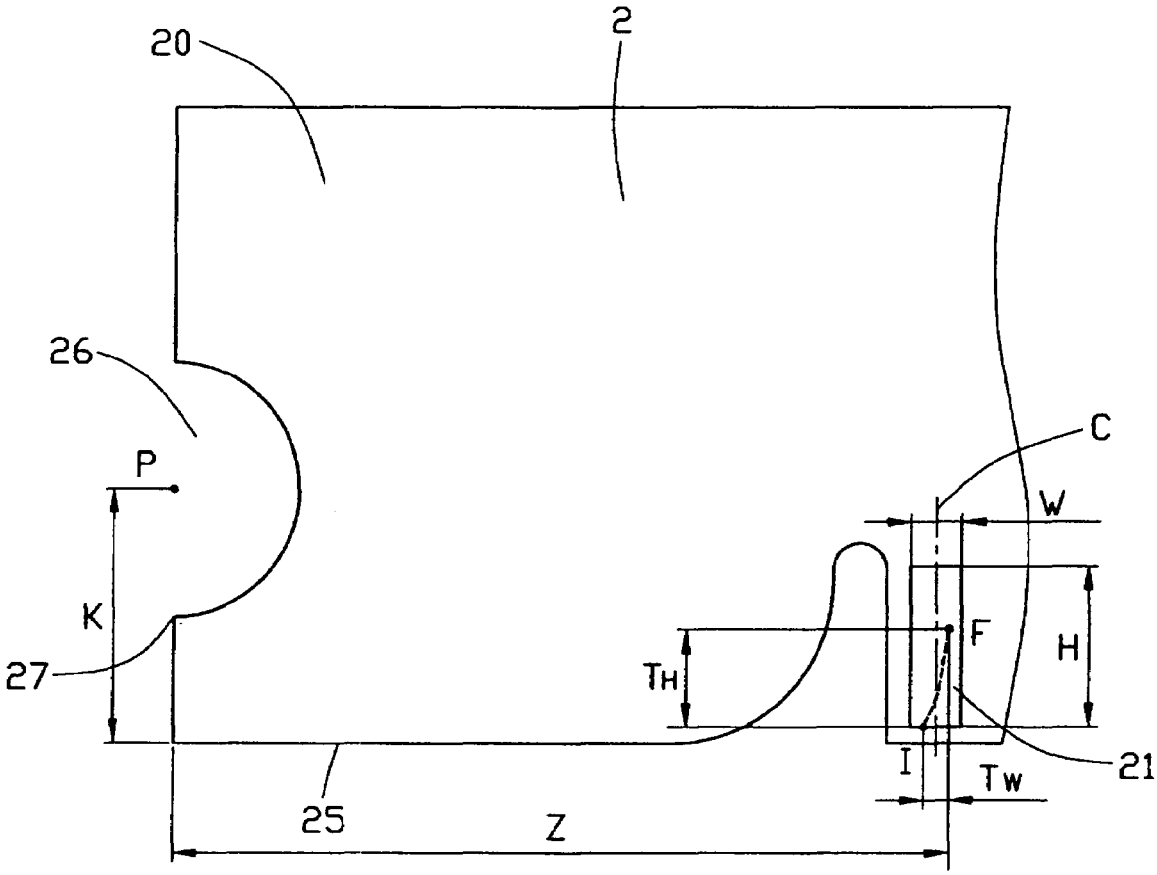
FIG. 4 is a partially planar view of the memory module of FIG. 1.

Referring to FIG. 4, during the movement of the memory module 2 with respect to the electrical connector 1, each terminal 12 is preferred to firstly contact with a corresponding conductive pad 21 at an initial point 1 and finally stay at a final point F in the corresponding conductive pad 21. The track between the initial point I and the final point F is usually an arc not a straight line. A first distance $T_W$ is defined between the points I and F along a direction along which the conductive pads 21 are arranged on the memory module 2 and is preferably not larger than a width W of the conductive pad 21. The first distance is preferably substantially a half of the width W and is centered around the pad center line C. A second distance $T_H$ is defined between the initial and the final points I and F along a direction perpendicular to the direction along which the conductive pads 21 are arranged on the memory module 2 and is preferably not larger than a height H of the conductive pad 21. The second distance $T_H$ is preferably about 60 percent of the height H of the conductive pad 21. That is, when the width of the conductive pad 21 is as usually set as 0.8 millimeters, the distance $T_W$ is preferably 0.4 millimeters and when the height of the conductive pad 21 is as usually set as 2.50 millimeters, the distance $T_H$ is preferably 1.52 millimeters.

A third distance Z is defined between the lateral end of the first side portion 20 and the final point F of the first conductive pad 21 measured from the first side portion 20 of the memory module 2. The third distance Z is substantially equal to a distance Z' (FIG. 2) defined between the supporting section 13 and the first terminal 12 of the electrical connector 1 measured from the first end 14 of the insulative housing 10.

A fourth distance K is defined between the lower end 25 of the lower portion 24 and a pivot point P about which the memory module 2 is rotated. The pivot point P can be set in the supporting section 13 or wherever appropriate. The fourth distance K is substantially equal to a distance K' (FIG. 2) defined between the pivot point P and the bottom face 19 of the slot 18 of the insulative housing 10. To ensure that the point I and the point F for each electrical terminal 12 be in a preferred target area of the very conductive pad 21 with which the electrical terminal 12 is finally mated, (a mathematical relationship is preferably held: $T_W^2-T_H^2=2\times(Z\times T_W-K\times T_H)$, which is obtained from the relationships of the trigonometric functions of the angle α, that is tangent α=cos α/sin α=K /Z=$T_W/T_H$) (with respect to the equation $T_W^2-T_H^2=2\times(Z\times T_W-K\times T_H)$, we need the inventor to explain how it goes out when replying us on the draft application). That is, to get a minimum value for the distance Z, the distance K is preferably minimum, and in this preferred embodiment, is chosen at 4 millimeters, which includes a 2-millimeter distance from the lower end 25 of the memory module to a lower end 27 of the cutout 26 and a 2-millimeter distance from the lower end 27 to the center point, the pivot point P, of the cutout 26. In this way, the value of the distance Z is attained as 12.38 millimeters.

Figure 5:
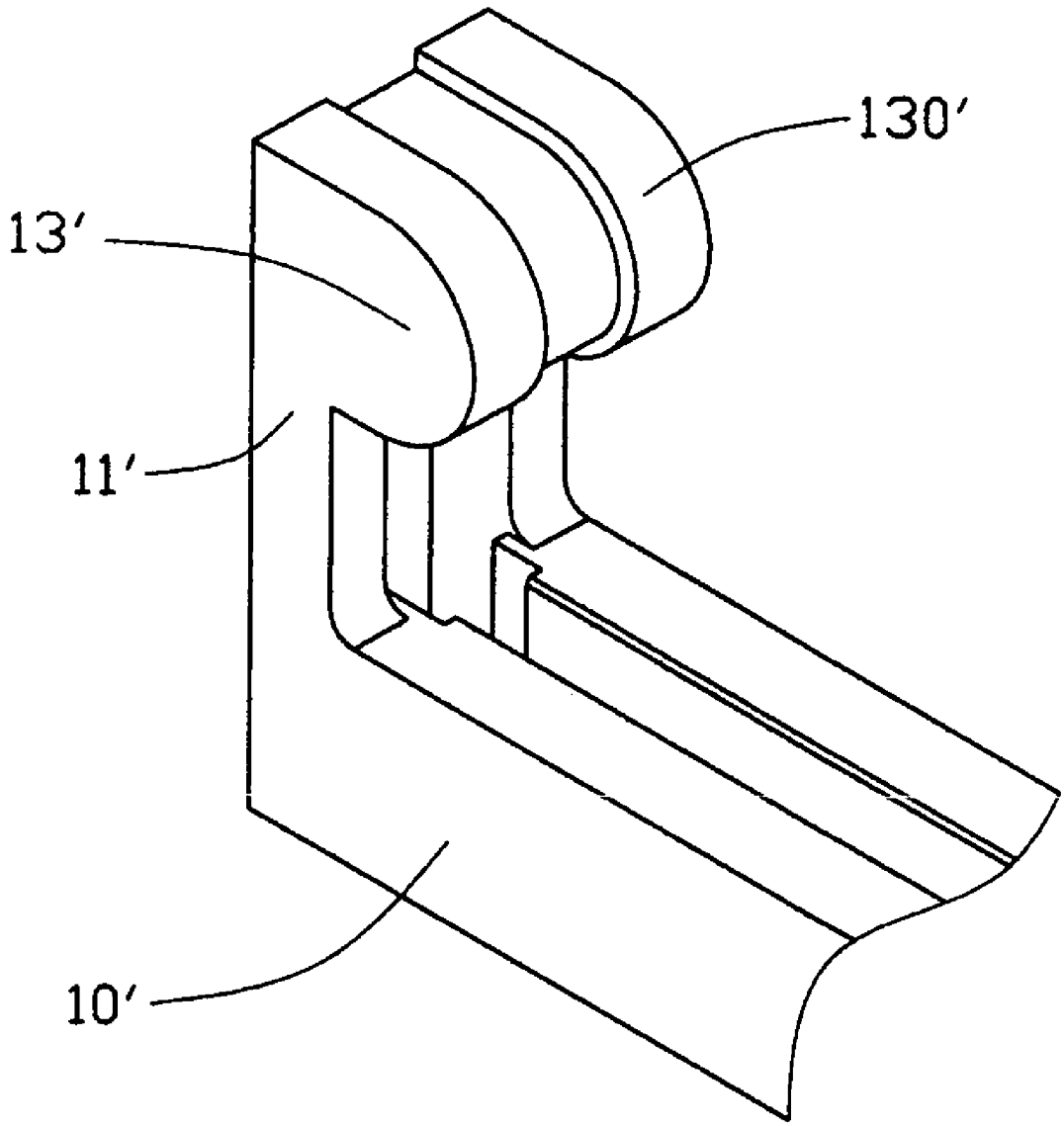
FIG. 5 is a partially cross-sectional view of an insulative housing of an electrical connector in accordance with a second embodiment of the present invention.

Referring to FIG. 5, a part of an insulative housing 10' of an electrical connector in accordance with a second embodiment of the present invention is shown. The electrical connector in accordance with the second embodiment is similar to the electrical connector 1 of the first embodiment except that the supporting section 13' comprises a pair of protrusions 130' spaced apart from each other. When the memory module 2 pivots about the supporting section 13', the protrusions 130' sandwich the first side portion 20 of the memory module 2 therebetween and restrict the movement of the memory module 2 with respect to the electrical connector along a lateral direction of the insulative housing 10'. In such a way, the memory module 2 can be retained in the electrical connector more reliably.

Figure 6:
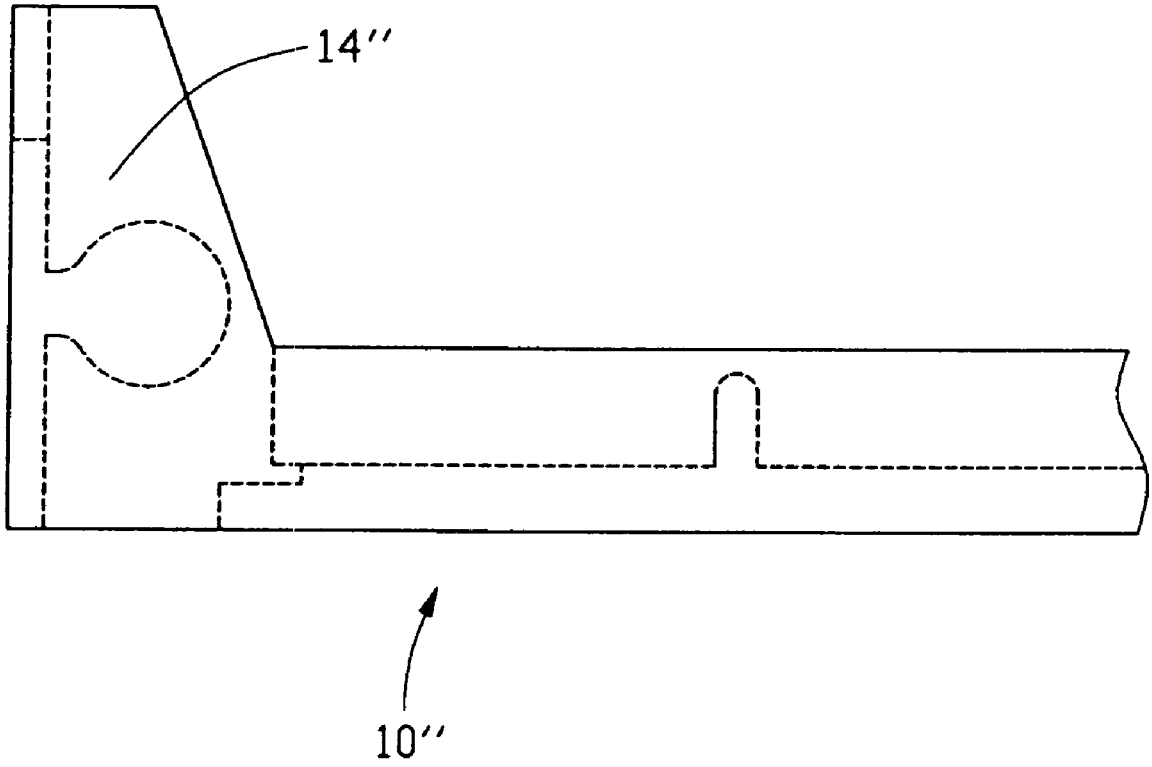
FIG. 6 is a front elevational view of a part of an insulative housing of an electrical connector in accordance with a third embodiment of the present invention.
Figure 7:
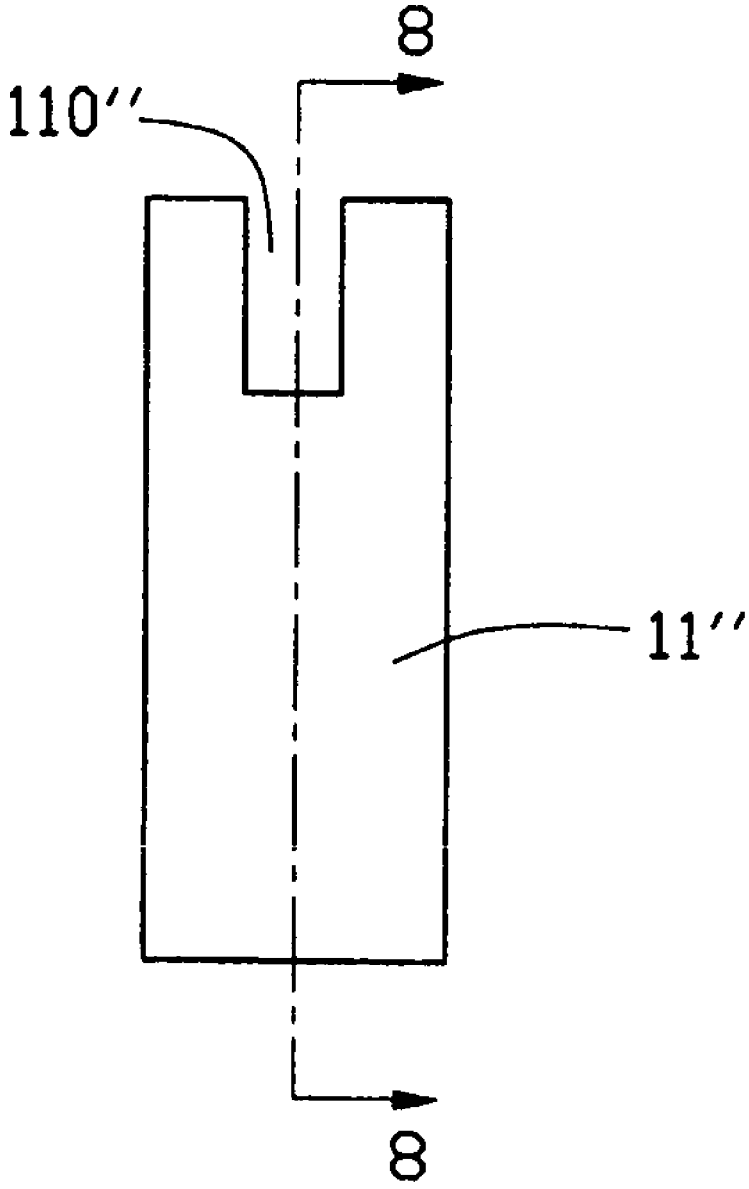
FIG. 7 is a side elevational view of the insulative housing of FIG. 6.
Figure 8:
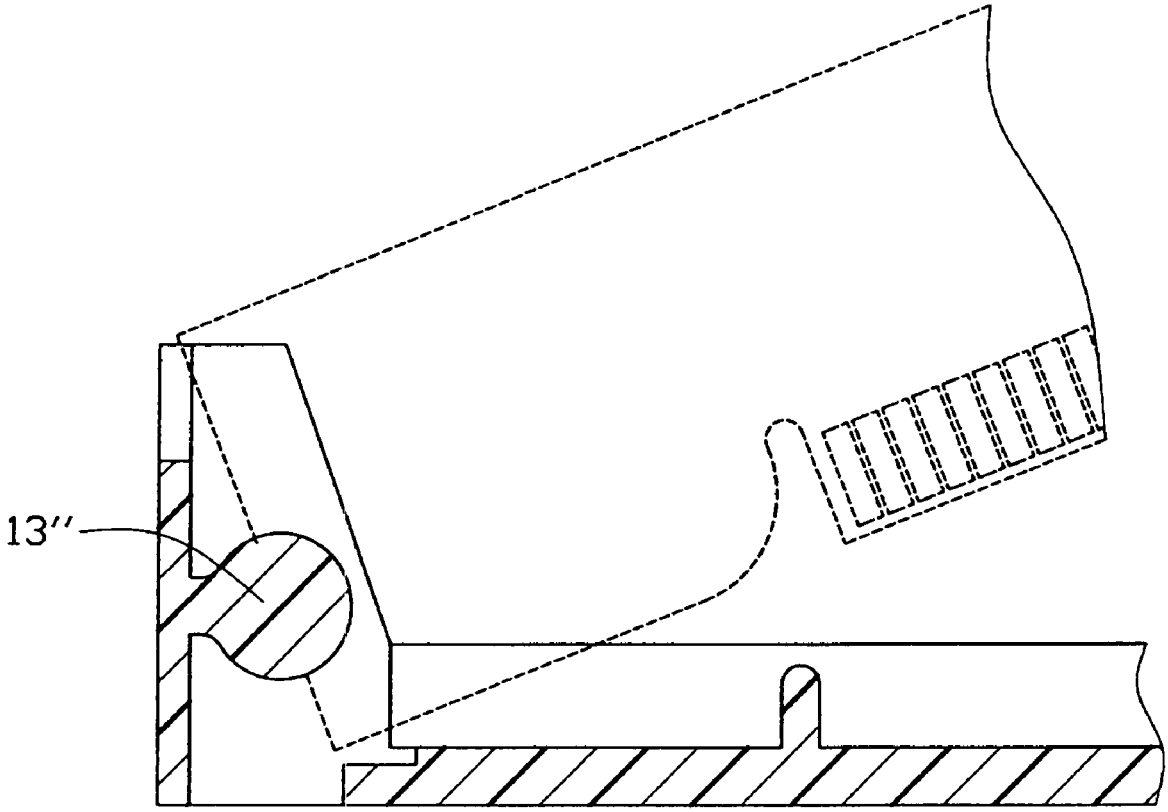
FIG. 8 is cross-sectional view taken along line 8—8 of FIG. 7 with a corresponding part of the memory module shown in phantom lines.

Referring to FIGS. 6–8, a part of an insulative housing 10" of an electrical connector in accordance with a third embodiment of the present invention is shown. The electrical connector of the third embodiment is similar to the electrical connectors of the two aforementioned embodiments except that the supporting section 13" is located adjacent to a lower section of the tower 11" of the first end 14" and a groove 110" is defined in a top face of the tower 11" and above the supporting section 13".

When the memory module 2 is inserted into or withdrawn from the electrical connector 1, the memory module 2 is pivoted about the supporting section 13, 13', 13" of the stationary tower 11, 11', 11" in such a way that the conductive pads 21 on the first side portion 20 contact with corresponding terminals 12 in the first end 14 earlier than the conductive pads 21 on the second side portion 22 and the second side portion 22 extends into the slot 18 later than the first side portion 20. Thus, a total force needed to insert the memory module 2 is significantly reduced due to the sequential engagement of the conductive pads 21 and the electrical terminals 12. Taking a memory module having 240 conductive pads for mating with an electrical connector having 240 electrical terminals for example, an insertion force needed to insert the memory module into the electrical connector in a way as disclosed in the present invention gets a more than 50%, 66%, reduction with respect to in convention way in which the memory module is inserted into the electrical connector parallelly.

Furthermore, since the supporting section 13, 13', 13" is stationary, only the memory module 2 needs to be manipulated, it is more easy for the user to manipulate the insertion process of the memory module 2 into the electrical connector. In addition, since the distances K and Z are well controlled, each terminal 12 mechanically contacts and electrically connects only and exactly with the very conductive pad 21 intended to be mated with in the course of mating the memory module with the electrical connector. A reliable electrical connection between the memory module and the electrical connector is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a memory module comprising a first side portion, an opposite second side portion, and a plurality of conductive pads, the first side portion comprising a side engaging section; and an electrical connector comprising an insulative housing comprising a first end, an opposite second end and a slot extending from the first end to the second end, and a plurality of electrical terminals mounted to the insulative housing, the first end comprising a stationary supporting section engageable with the side engaging section to support the memory module to rotate thereabout to mate the conductive pads with the electrical terminals sequentially from the first end to the second end, each electrical terminal mechanically contacted with and electrically connected with one corresponding conductive pad in the course of mating the memory module with the electrical connector;

wherein each conductive pad defines a track from an initial point at which the electrical terminal firstly contacts therewith to a final point at which the electrical terminal finally mated therewith in the course of mating the memory module with the electrical connector;

wherein the initial point and the final point define a first distance $T_w$ therebetween along a first direction along which the conductive pads are arranged on the memory module and wherein the conductive pad defines along the first direction a width no less than the first distance $T_w$:

wherein the initial point and the final point define a second distance $T_H$ therebetween along a second direction perpendicular to the first direction and wherein the conductive pad defines along the second direction a height no less than the second distance $T_H$;

wherein the final point of a first one of the conductive pads of the memory module measured from the first side portion defines, along the first direction, a third distance Z with respect to a lateral end of the first side portion, the third distance Z being substantially equal to a distance defined between a first one of the electrical terminals of the electrical connector and the supporting section;

wherein the memory module comprises a lower end defining a fourth distance K with respect to a pivot point about which the memory module rotates, and wherein the slot comprises a bottom face defining, with respect to the pivot point, a distance substantially equal to the fourth distance K;

wherein the first to the fourth distances are subject to a mathematical relationship therebetween: $T_w^2-T_H^2=2\times Z\times T_w-2\times K\times T_H$.

2. The electrical connector assembly as claimed in claim 1, wherein the second side portion comprises a locking section and wherein the second end comprises a moveable lever locking with the locking section of the memory module.

3. The electrical connector assembly as claimed in claim 2, wherein the locking section is a cutout and the lever comprises a projection engageable with the cutout.

4. The electrical connector assembly as claimed in claim 1, wherein the first distance $T_w$ is substantially 50 percent of the width of the conductive pad and is centered around a center line of the conductive pad.

5. The electrical connector assembly as claimed in claim 1, wherein the second distance $T_H$ is about 60 percent of the height of the conductive pad.

* * * * *